United States Patent [19]

Stephano

[11] Patent Number: 4,567,550

[45] Date of Patent: Jan. 28, 1986

[54] AUTOMOBILE HEADLAMP WITH INCLINED FRONT GLASS

[75] Inventor: Marc Stephano, Gargan, France

[73] Assignee: Cibie Projecteurs, Bobigny, France

[21] Appl. No.: 604,737

[22] Filed: Apr. 27, 1984

[30] Foreign Application Priority Data

Apr. 27, 1983 [FR] France ..... 83 06945

[51] Int. Cl.[4] ..... F21V 7/09

[52] U.S. Cl. ..... 362/297; 362/347

[58] Field of Search ..... 362/297, 309, 346, 347

[56] References Cited

U.S. PATENT DOCUMENTS 2,143,435 1/1939 Dietrich ..... 362/309

FOREIGN PATENT DOCUMENTS 1518841 3/1968 France .

2394743 1/1979 France .

650352 2/1951 United Kingdom ..... 362/309

*Primary Examiner*—Tony M. Argenbright

*Attorney, Agent, or Firm*—McCormick, Paulding & Huber

[57] ABSTRACT

The invention relates to an automobile headlamp having a light source co-operating with a principal reflector of generally parabolic form, and a glass which is greatly inclined with respect to the vertical. Selected critical zones of the reflector have an elliptical form with one focus in the proximity of the light source and the other focus in the proximity of the center of the glass, and the central zone of the glass is substantially smooth, in such a way that the light rays reflected by the critical zones of the reflector pass through the glass without significant deflection in spite of its inclination.

1 Claim, 14 Drawing Figures

AUTOMOBILE HEADLAMP WITH INCLINED FRONT GLASS

BACKGROUND OF THE INVENTION

The present invention relates to automobile headlamps provided with an inclined glass and a generally parabolic reflector.

In general automobile headlamps have a reflector co-operating with at least one light source in order to reflect a beam of essentially parallel rays in the direction of a diffusion glass which can be integral either with the reflector or with the body of the automobile. The glass is provided at least in certain regions with diffusion ribs and/or prisms in order to give a suitable spread to the beam which is finally emitted.

In modern automobile constructions there is a tendency for aesthetic reasons to give the glasses an inclination corresponding to the lines of the vehicle, this inclination generally being from top to bottom and from back to front. Thus very great inclinations of the glass can be achieved, for example of the order of 45° with respect to the vertical. In certain cases, for example for headlamps placed below a grille, the inclination may be in the opposite direction.

In such structures, the inclination of the glass results in a deflection downwards of certain light rays, in particular those which the glass should deflect horizontally. It might be mentioned that for a glass inclined at 45° a ray deflected horizontally by 17° is deflected vertically by 2.5°. This results in illumination which is no longer satisfactory, particularly for the rays which form the dipped beam below the cut-off.

FIGS. 1 and 1*a*, 2 and 2*a* illustrate this difficulty.

FIG. 1 shows a conventional headlamp incorporating a parabolic reflector R having a focus F, two filaments for main beam and dipped beam $F_R$ and $F_C$ and a glass closure G. The dipped beam filament $F_C$ is advantageously arranged a little in front of the focus F of the reflector; the main beam filament $F_R$ is slightly displaced towards the rear, encroaching a little on the focus. In the example of FIG. 1 the glass G is vertical. The illumination given by such a headlamp on a standard screen at 25 meters is shown in FIG. 1*a*. For a central zone of the glass provided with the usual deflecting ribs this gives a band of light the limit of which is horizontal, as shown in FIG. 1*a*.

If one considers the headlamp of FIG. 2, where the glass G which is analogous to the preceding one and is in this case inclined, the band of light is curved as shown in FIG. 2*a*. Thus the beam is deflected along its width. This change in the appearance of the beam is not satisfactory since all the light thus lowered impinges upon the road too close to the vehicle and is at least partially situated outside the driver's field of vision. This results in a substantial reduction in driving comfort.

This disadvantage is general but applied more particularly to the formation of the dipped beam for rays situated immediately below the cut-off.

SUMMARY OF THE INVENTION

It is an object of the present invention to resolve this problem, that is to say to correct the unwanted deflection of the beam due to the inclination of the glass.

According to the invention there is provided an automobile headlamp of the type comprising at least one light source, at least one principal reflector of generally parabolic form with which said light source co-operates, and a front glass which is greatly inclined with respect to the vertical, wherein said reflector has selected critical zones, said zones having an elliptical shape with one focus in the proximity of said light source and the other focus in the proximity of the centre of said glass, and wherein the central zone of said glass is substantially smooth whereby light rays reflected by said critical zones of said reflector pass through said glass without significant deflection in spite of its inclination.

Thus, the reflector of the headlamp is modified in certain zones so that the light rays which they reflect have a suitable orientation and pass through the glass in a limited central zone which does not contain any notable elements for deflection or diffusion. The form of these zones of the reflector departs from the parabolic form maintained elsewhere and the corresponding central zone of the glass is modified so as to contain no or hardly any elements for deflection and/or diffusion.

Preferably, the modified zones of the reflector are central zones extending in circular sectors to the left and to the right of the optical axis of the reflector, and preferably, the corresponding zone of the glass is its central zone in a limited region also having the form of two sectors extending to the left and to the right of the optical axis, this zone having substantially no elements for deflection and/or diffusion.

The modification of the zones is preferably obtained by locally superimposing auxiliary reflecting portions on the surface of the parabolic reflector which is otherwise generally maintained in its parabolic form.

The invention may be particularly useful in applications for the formation of dipped beams, the aforesaid modified zones providing illumination immediately below the cut-off; however, these applications are not limiting and the invention may also apply to fog lamp beams.

DESCRIPTION OF THE PREFERRED EMBODIMENTS

Figure 1:
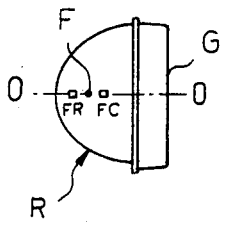
FIG 1 PRIOR ART
FIG. 1 is a somewhat schematic side view of a conventional headlamp incorporating a conventional prior art headlamp incorporating a parabolic reflector having a focus F, two filaments respectively for a main and dipped beam $F_R$ and F and C and a glass closure G.
Figure 2:
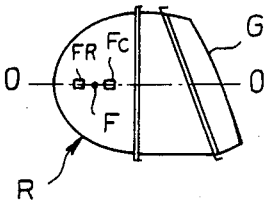
FIG 2 PRIOR ART
FIG. 2. is a somewhat schematic side view of a headlamp similar to the headlamp of FIG. 1 but with an upwardly and rearwardly inclined front glass G.
Figure 3:
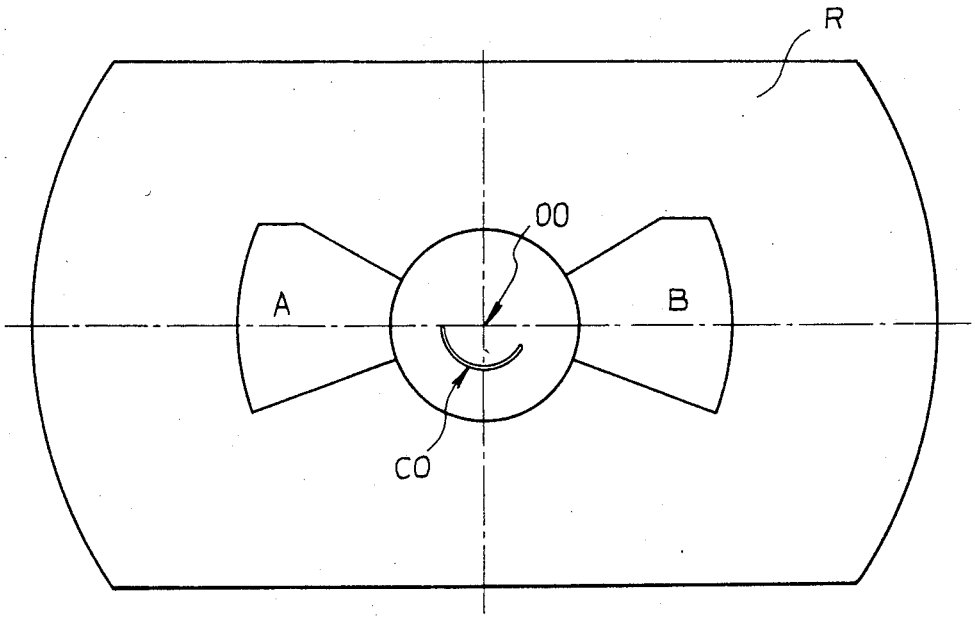
FIG. 3 is a schematic front view of a parabolic reflector for use with an inclined glass and having modified zones according to the invention.

In order to simplify the explanation in connection with FIGS. 3 to 5*c*, the text will be confined to the case of a reflector which, as shown in FIG. 3, has a generally rectangular aperture co-operating with a filament $F_C$ (as in FIGS. 1 and 2), slightly in front of the focus F of the reflector R which has an axis OO.

The main part of the reflector R remains parabolic having a focus F. With a dipped beam filament $F_C$ surrounded as is customary by a screening cap CO, a typical distribution of the cut-off light obtained on a screen is shown in FIG. 5*a*. If such a reflector is made to co-operate with an inclined glass provided in the normal way with optical elements for deflection and diffusion (prisms and/or ribs), this results in a suitable spread of the beam at the same time, as has been indicated (and illustrated in FIG. 2*a*), an undesirable deflection.

To avoid this situation, two zones A and B which extend as two limited circular sectors to the left and to the right of the optical axis OO of the reflector are modified. FIG. 3 illustrates this arrangement, and the relative dimensions and arrangements which appear in the Figure are accurate and form an integral part of this embodiment of the invention.

The modified reflecting zones A and B do not have a parabolic shape but are elliptical, the ellipsoid of reference having one focus substantially coinciding with the filament $F_C$ and the other focus in the proximity of the inclined glass G. Thus a ray emitted by $F_C$ and striking a point on the zones A and B will pass through the glass G in the proximity of its centre.

The general effect of this arrangement is to give to the rays reflected by the modified zones A and B a certain lateral deflection, which would not exist without the modification, and to eliminate the effect of deflection usually associated with the inclination of the glass.

Figure 5B:
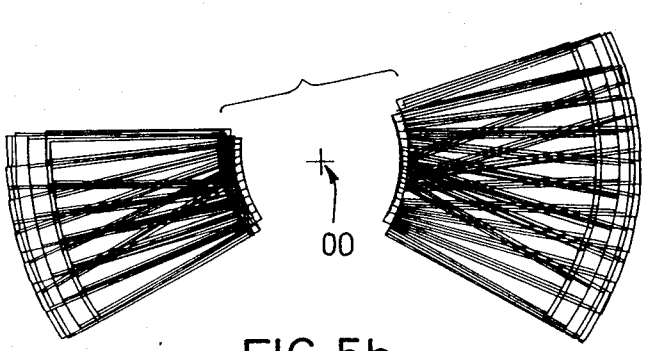
FIGS. 5*a*, 5*b*, 5*c* show the illumination obtained in a standard screen at 25 meters, FIG. 5*a* showing the illumination obtained without modification of the reflector, FIG. 5*b* showing the images given by the zones of the reflector which are to be modified but before modification, and FIG. 5*c* showing the images obtained on the screen after modification of these zones.
Figure 5A:
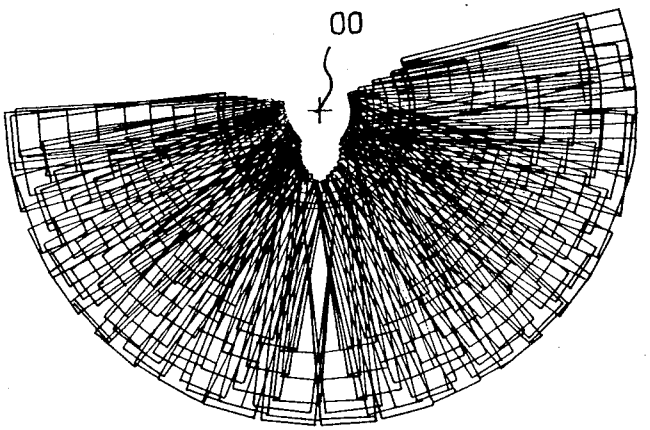
Figure 5C:
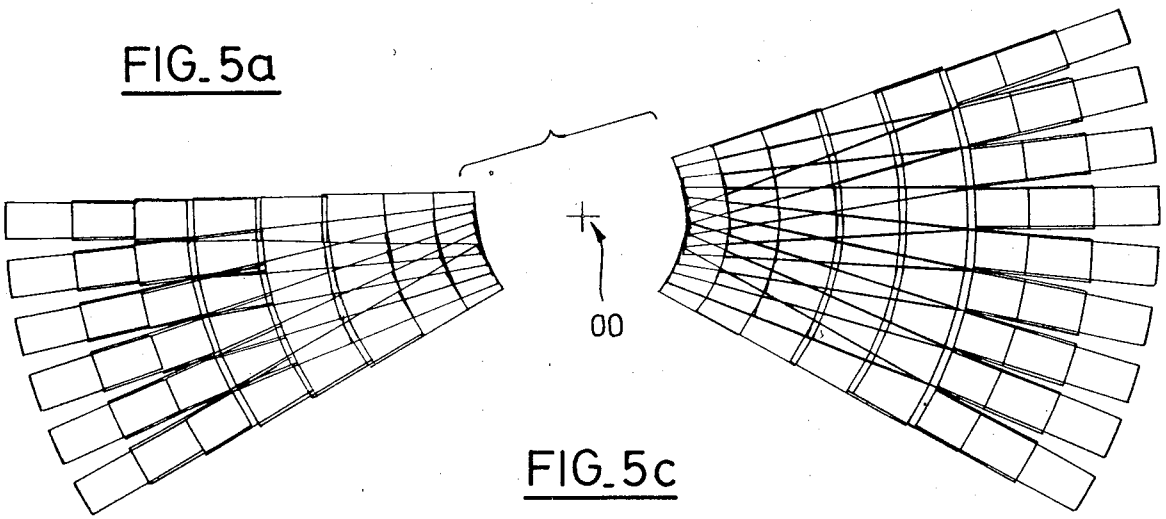

FIG. 5*b* shows the images of the filament $F_C$ given by the zones A and B of a parabolic reflector on a standard screen at 25 m when these zones are parabolic and without modifications. The different radial images of the filament can be distinguished. When these two zones A and B are given an elliptical form as indicated above, the same projection on a screen at 25 m gives an arrangement of the radial images of the filament $F_C$ as shown in FIG. 5*c*. A lateral spread of the beam due to radial dispersion of the images of the filament $F_C$ can be observed.

Figure 4B:
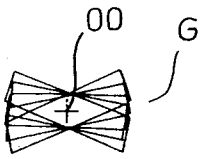
FIG. 4*b* is a view similar to FIG. 4*a* showing the images given by the modified zones.
Figure 4A:
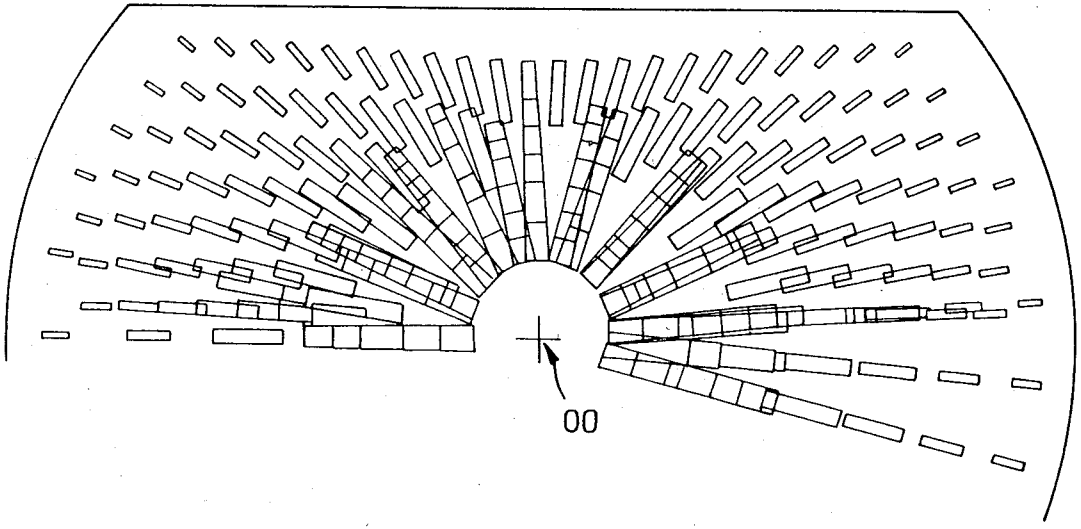
FIG. 4*a* is a view of the interior of the glass showing the projection on the latter of images of a dipped beam filament formed by reflection on the parabolic part of the reflector of FIG. 3.

FIGS. 4*a* and 4*b* show the formation of the images at the glass. The unmodified zones of the reflector R give the distribution of images shown in FIG. 4*a*. The images extend radially all around a central zone corresponding to the central aperture of the reflector. By contrast, the images given the elliptical zones A and B as shown in FIG. 4*b* appear as a double sector at the central zone of the glass.

Essentially, therefore a headlamp with an inclined glass may be produced according to the invention by giving the elliptical form defined above to the zones A and B of the reflector and giving a smooth structure, or in any case a structure which is only slightly deflecting and/or diffusing, to the corresponding central part of the inclined glass G.

Two embodiments of applications will now be described.

Figure 6A:
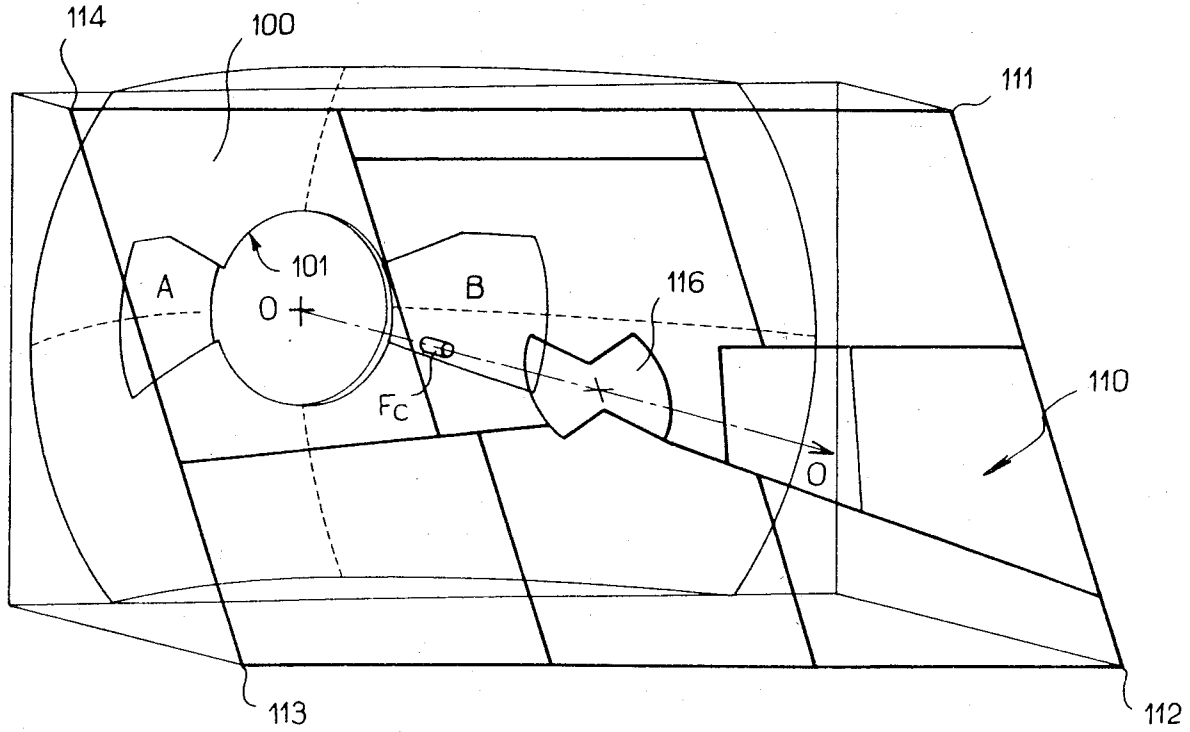
FIG. 6*a*, is a schematic perspective view of one embodiment according to the invention for forming a dipped/main beam.
Figure 6B:
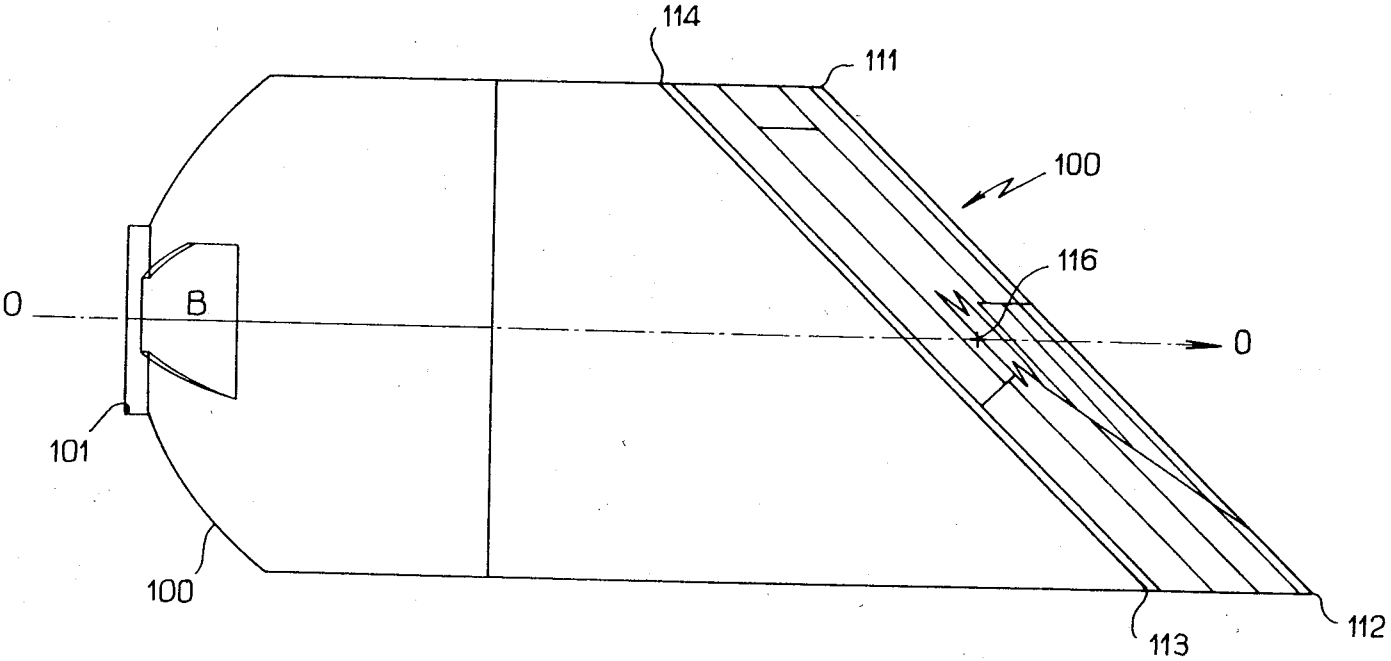
FIG. 6*b* is a side view of the headlamp of FIG. 6*a*.
Figure 6C:
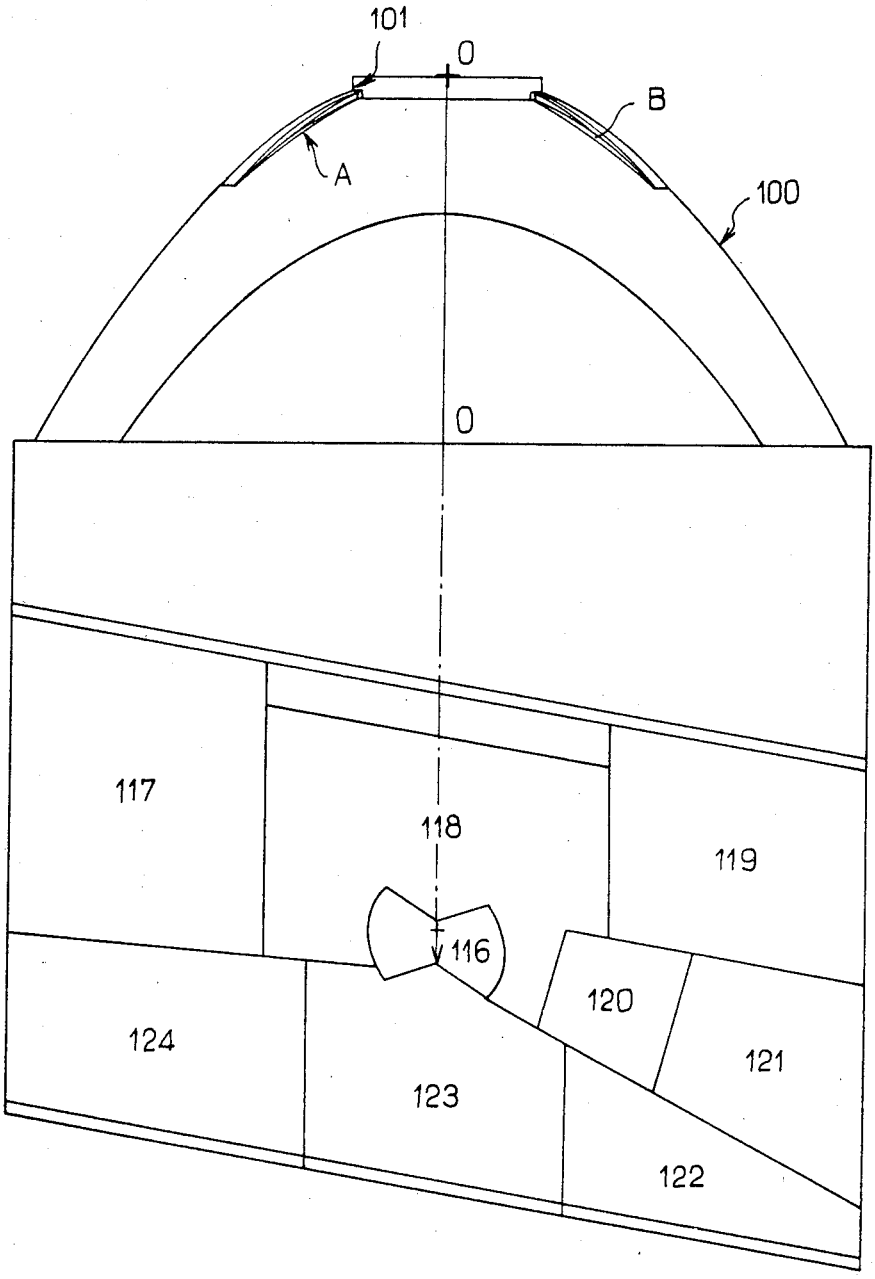
FIG. 6*c* is a plan view of the headlamp of FIG. 6*a*.

FIGS. 6*a*, 6*b*, 6*c* show schematically in perspective, in side view and in plan, a headlamp according to the invention for dipped/main beam. This headlamp has a principal reflector 100 and a glass 110 having a contour 111–112–113–114. This contour is inclined from top to bottom, from back to front and, slightly, from left to right with respect to the direction of illumination according to the optical axis OO.

Figure 1A:
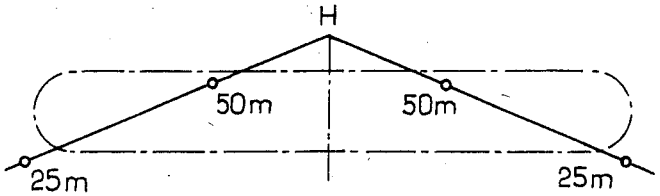
FIG 1a PRIOR ART
FIG. 1*a* is a schematic illustration of the illumination provided by the prior art headlamp of FIG. 1, the pattern of illumination being shown on a standard screen at 25 meters.
Figure 2A:
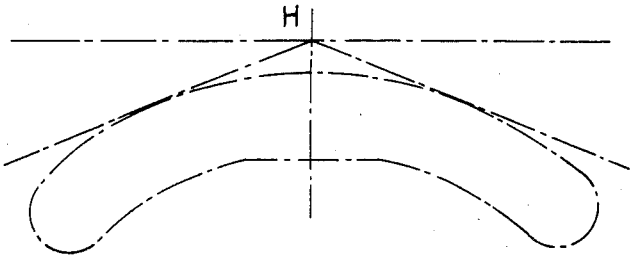
FIG 2a PRIOR ART
FIG. 2*a* is a somewhat schematic showing of the illumination provided by the prior art headlamp of FIG. 2 on a standard screen at 25 meters.

The reflector 100 is generally parabolic in shape about the axis OO. Its base has a circular central aperture 101 which serves in a manner which is known per se for mounting a dipped/main beam bulb having two filaments (filaments $F_C$ and $F_R$ as shown in FIGS. 1*a* and 2*a*).

The reflector 100 has two reflecting zones A and B which are elliptical, one of the foci of the elliptical surface being located in the proximity of the dipped beam filament $F_C$, the other focus in the proximity of the centre of the glass 110. With such an arrangement any light ray emitted by the filament $F_C$ and reflected by the zones A, B passes through the glass inside the contour 116 which has the form of a double circular sector as shown in the drawings (and like zones A and B).

From the optical point of view the glass 110 is provided with prisms or ribs distributed in regions 117–124 (FIG. 6*c*) in the usual way in order to deflect and diffuse the light rays emitted by the dipped beam and the main beam filaments and reflected by the reflector 100 outside the zones A and B.

The zones 116 of the glass has hardly any element for diffusion and deflection. The elliptical zones A and B of the reflector reflect the emitted rays of the filament FC which thus pass freely through the zones 116 in order to form a flux concentrated just below the cut-off. Although it is very inclined, the glass does not play any optical part in deflecting these rays for which it acts as a simple lamina with parallel faces.

Figure 7:
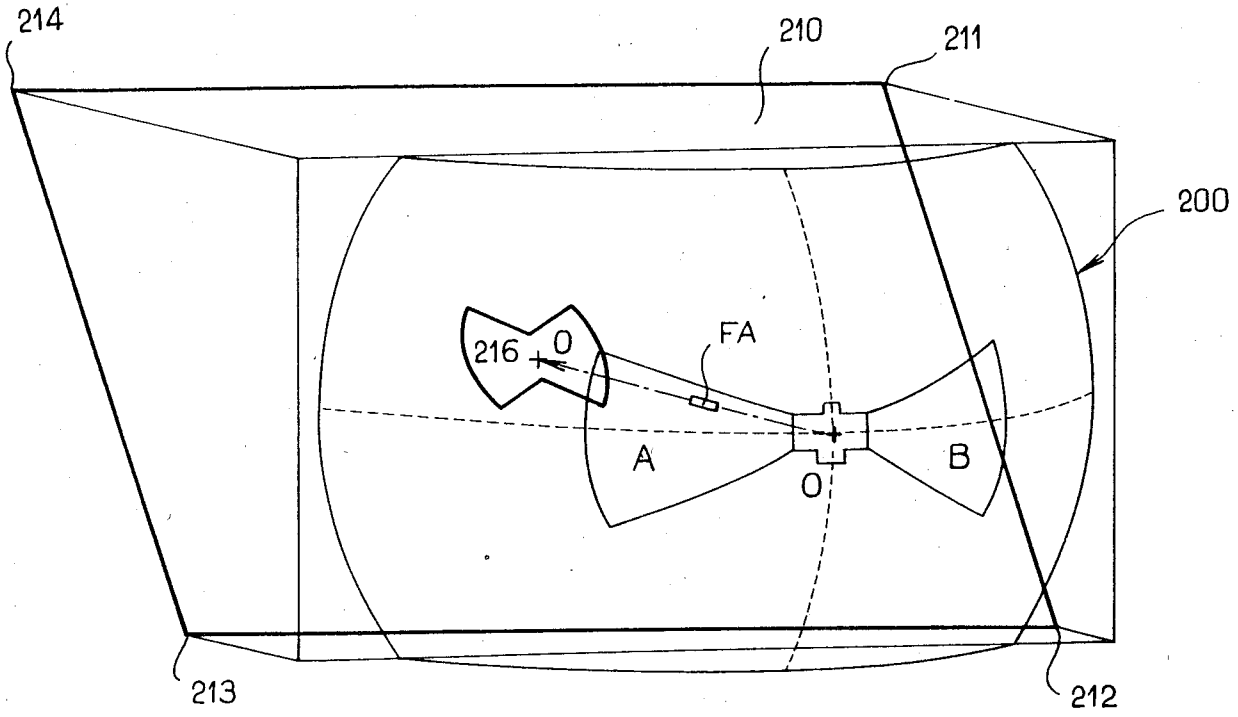
FIG. 7 is a schematic perspective view of a second embodiment according to the invention.

FIG. 7 shows schematically a fog lamp consisting of a parabolic reflector 200 having an axis OO and provided with two elliptical zones A and B, a glass 210 of contour 211, 212, 213, 214 which in this case is inclined from top to bottom and from front to back: this is a fog lamp placed below a grille. As in the previous embodiment, the glass 210 has a central zone 216 which is substantially smooth. The light rays emitted by the fog lamp filament $F_A$ and reflected by the zones A and B pass freely through the glass in its smooth part 216 in order to form the useful fog lamp beam without deflection in spite of the inclination.

Naturally, the invention is not limited to the embodiments described but extends to any variant conforming to the spirit thereof, the claims accompanying the present application forming an integral part thereof. In particular, the invention is not limited to the formation of the dipped beams or fog lamp beams, but extends to all headlamps in which an essentially parabolic reflector is rendered elliptical in order to reflect certain light rays in a substantially smooth central zone of the glass, the reflector alone thus giving these rays the deflection appropriate for use. Finally, the central zone of the glass should not deflect the light rays significantly in any direction; it is in this sense that it can be said to be substantially smooth; however, the expert in the art will understand that this term also covers a zone which is slightly ribbed.

This specification describes the case of headlamps for driving on the right, however, it will be appreciated that the features may be laterally inverted for driving on the left in a way which will be evident to those skilled in the art.

Obviously, numerous modifications and variations of the present invention are possible in the light of the above teachings. It is therefore to be understood that within the scope of the appended claims, the invention may be practiced otherwise than as specifically described herein.

What is claimed as new and desired to be secured by Letters Patent of the United States is:

1. An automobile headlamp of the type comprising at least one light source, at least one principal reflector of generally parabolic form having a main focus and a central aperture, said light source being a dipped filament close to said main focus and cooperating with said principal reflector, a front glass which is greatly inclined with respect to the vertical, said reflector having selected critical zones, said zones having an elliptical shape with one focus in the proximity of said light source and the other focus in the proximity of the centre of said glass, said critical zones being formed by two circular sectors arranged to the left and to the right of said principal reflector adjacent said central aperture, the the central zone of said glass corresponding to said critical zones being substantially smooth whereby light rays reflected by said critical zones of said reflector pass through said glass without significant deflection in spite of the inclination of the glass.

* * * * *